US006604446B1

(12) United States Patent
Skirde et al.

(10) Patent No.: US 6,604,446 B1
(45) Date of Patent: Aug. 12, 2003

(54) INCLINED-AXIS VARIABLE DISPLACEMENT UNIT

(75) Inventors: Eckhard Skirde, Aukrug-Böken (DE); Vladimir Galba, Nova' Dubnica (SK)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/948,986

(22) Filed: Sep. 7, 2001

(30) Foreign Application Priority Data

Sep. 11, 2000 (DE) ..... 100 44 782

(51) Int. Cl.[7] ..... F01B 13/04
(52) U.S. Cl. ..... 92/12.2; 91/505
(58) Field of Search ..... 92/57, 71, 12.2; 91/504, 505; 74/839

(56) References Cited

U.S. PATENT DOCUMENTS 4,034,650 A * 7/1977 Molly ..... 91/505
4,253,381 A * 3/1981 Wartelle ..... 91/506
4,617,853 A * 10/1986 Wagenseil et al. ..... 91/505
4,893,549 A * 1/1990 Forster ..... 92/12.2

* cited by examiner

*Primary Examiner*—Edward K. Look
*Assistant Examiner*—Michael Leslie

(57) ABSTRACT

An inclined-axis variable displacement unit has an output shaft (1), mounted in a housing (4) of the unit, and a cylinder block (10), these being connected via a synchronizing articulation (13), and via working pistons (11) which can be displaced axially in the cylinder block (10), the cylinder block (10) being mounted axially in a pivoting body (5) which can be pivoted in relation to the axis of the output shaft (1) and has two symmetrical cylinder segments (51, 52) which are mounted for hydrostatic sliding action in mutually opposite concave cylindrical hollows (41, 42) in the inner surface of the housing (4).

11 Claims, 4 Drawing Sheets

INCLINED-AXIS VARIABLE DISPLACEMENT UNIT

BACKGROUND OF THE INVENTION

The invention relates to an inclined-axis variable displacement motor and an inclined-axis variable displacement pump or an axial piston machine of inclined-axis construction.

The generally known operating principle of such machines is based on an oil-volume stream being converted into a rotary movement.

BRIEF SUMMARY OF THE INVENTION

The prior art discloses an axial piston machine in which a cylinder block which is pivoted in relation to the axis of the output shaft is arranged on an adjustable valve segment. By way of this valve segment, the hydraulic oil, as operating fluid, is directed from the cylinder block into the stationary end housing of the motor. This solution has the inherent disadvantage that, on account of the design, the throughflow cross sections between the adjustable valve segment and the end housing cannot be of large enough design, which is then associated with corresponding energy losses in the case of relatively high throughflow volumes of the flowing operating fluid. In this prior-art solution, a detrimental effect is produced by the abovementioned limitation in the throughflow cross sections even with a maximum pivoting angle of the axis of the cylinder block in relation to the axis of the output shaft. This limitation basically increases as the pivoting angle increases. A further disadvantage of such piston machines is that the maximum value of the pivoting angle cannot readily be increased since this results in the dimensions and the design of such a piston machine having to meet more stringent requirements which, from certain limits, is no longer acceptable from a technical or commercial viewpoint.

Within the context of a further prior-art solution of such axial piston machines, the cylinder block is mounted in a pivoting body which, in turn, is mounted in the housing on two pins by a radial rolling-contact bearing. These pins have channels which pass through the pins and through it the hydraulic oil can flow from the pivoting body into the stationary part of the housing either in the axial direction or in the radial direction around the entire circumference of the pins. Such an inclined-axis variable displacement motor requires greater installation dimensions precisely in the region of the mounting of the pivoting body and in the region of the distribution of the operating fluid. Furthermore, its practical use is limited by the weight and the increased material consumption.

Patent DE 198 33 711 discloses a solution for an inclined-axis variable displacement motor, in which a movable intermediate plate is arranged between a valve segment and the functionally connected stationary part of the motor housing. The position of this intermediate plate is synchronized relative to the valve segment and to the stationary part of the motor housing via a mechanism which has three pins and is mounted on both sides of said valve segment. With smaller values of the maximum possible pivoting angle of the cylinder block, this configuration of an axial piston machine can, in part, eliminate the disadvantages from the abovementioned prior art. However, this entails, at the same time, an undesirable increase in the production costs, in the weight and in the design outlay for such a piston machine.

Therefore the principal object of the present invention is to provide an inclined-axis variable displacement unit or an axial piston machine of inclined-axis construction in which the mounting of the pivoting body does not limit, or even prevent, the transfer and/or introduction of the operating fluid in much higher pivoting-angle ranges.

SUMMARY OF THE INVENTION

The essential principle realized by the invention is based on a hydrostatic slide mounting of the pivoting body within the housing of the unit, additional bearing components, such as pins, rolling-contact bearings, or the like, being completely dispensed with.

The pivoting body is divided into two corresponding symmetrical cylinder segments which are arranged on both sides of the axis of rotation of the cylinder block, which is mounted axially in the pivoting body. In those surfaces directed towards the housing, said cylinder segments are mounted in corresponding recesses or bowl-like hollows in the inner surface of the housing. Located between the hollows and the bearing surfaces of the symmetrical cylinder segments, for the purpose of forming the hydrostatic slide mounting, is a corresponding oil layer.

In a preferred embodiment of the inclined-axis variable displacement unit according to the invention, the hollows are arranged in the inner surface of the housing at a location in which an imaginary cylinder plane which is defined jointly by; the outer cylinder surfaces of the opposite cylinder segments intersects the cylinder block, which is mounted axially in the pivoting body, in a plane which is located just beneath that end side of the cylinder block which is directed towards the output shaft, in the region of the mounting of the working pistons in said cylinder block.

Each cylinder segment has, in its cylindrical part, a throughflow chamber and a compensation chamber, which are enclosed by sealing edges or sealing zones. Corresponding throughflow chambers open out into the hollows forming the mounting. In the region of the mounting according to the invention, the throughflow chambers of the hollows are connected to the throughflow chambers of the cylinder segments. This ensures that the transfer and/or introduction of the hydraulic oil, as operating fluid, takes place in the region of the mounting, in which case the operating fluid then serves, at the same time, as hydrostatic sliding fluid.

Stationary transfer channels are arranged in the housing and open out into the corresponding throughflow chambers of the concave cylindrical hollows.

Correspondingly, the throughflow chambers of the cylinder segments are connected to non-stationary transfer channels. Circle-segment channels are arranged in the base of the pivoting body, the non-stationary transfer channels opening out into said circle-segment channels on the side correspondingly associated with the latter.

Each compensation chamber may be connected via a corresponding connecting channel, either to a non-stationary transfer channel or to a circle-segment channel which, as seen relative to the axis of rotation of the cylinder block, is located on the side opposite to the corresponding cylinder segment.

In a preferred embodiment of the inclined-axis variable displacement unit according to the invention, said non-stationary transfer channels are each formed from two channels which run essentially parallel to one another.

The base of the pivoting body preferably has a trapezoidal cross section in the plane which is defined by the axis of rotation of the cylinder block, on the one hand, and by the axis of the output shaft, on the other hand.

The output shaft of said inclined-axis variable displacement unit according to the invention is mounted in the housing by a first rolling-contact bearing and a second rolling-contact bearing, the first rolling-contact bearing being located in the side directed towards the pivoting body. According to the invention, the end plane of the outer race of the first rolling-contact bearing is located in a separating plane of the two-part housing.

DESCRIPTION OF THE PREFERRED EMBODIMENT(S)

Figure 1:
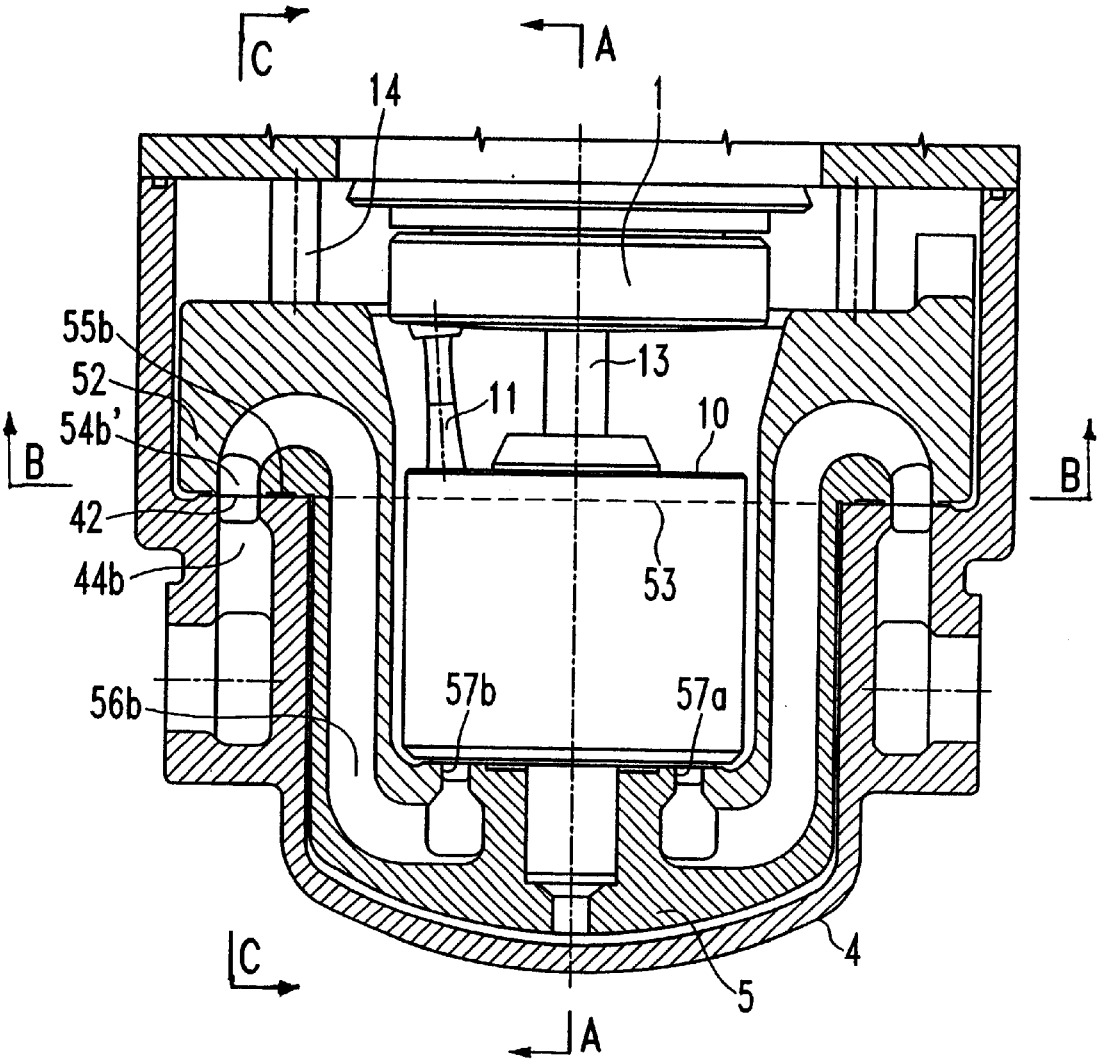
FIG. 1 shows a cross section of the inclined-axis variable displacement unit according to the invention in the plane defined by the axis of the output shaft, said cross section illustrating the mounting of the pivoting body in the housing and the course taken by the transfer channels.

FIG. 1 illustrates a housing 4 of the unit, within which a pivoting body 5 is mounted. Located in an axially mounted manner with in said pivoting body 5, in turn, is a cylinder block 10. The cylinder block 10 is connected to an output shaft 1 via a synchronizing articulation 13.

Figure 2:
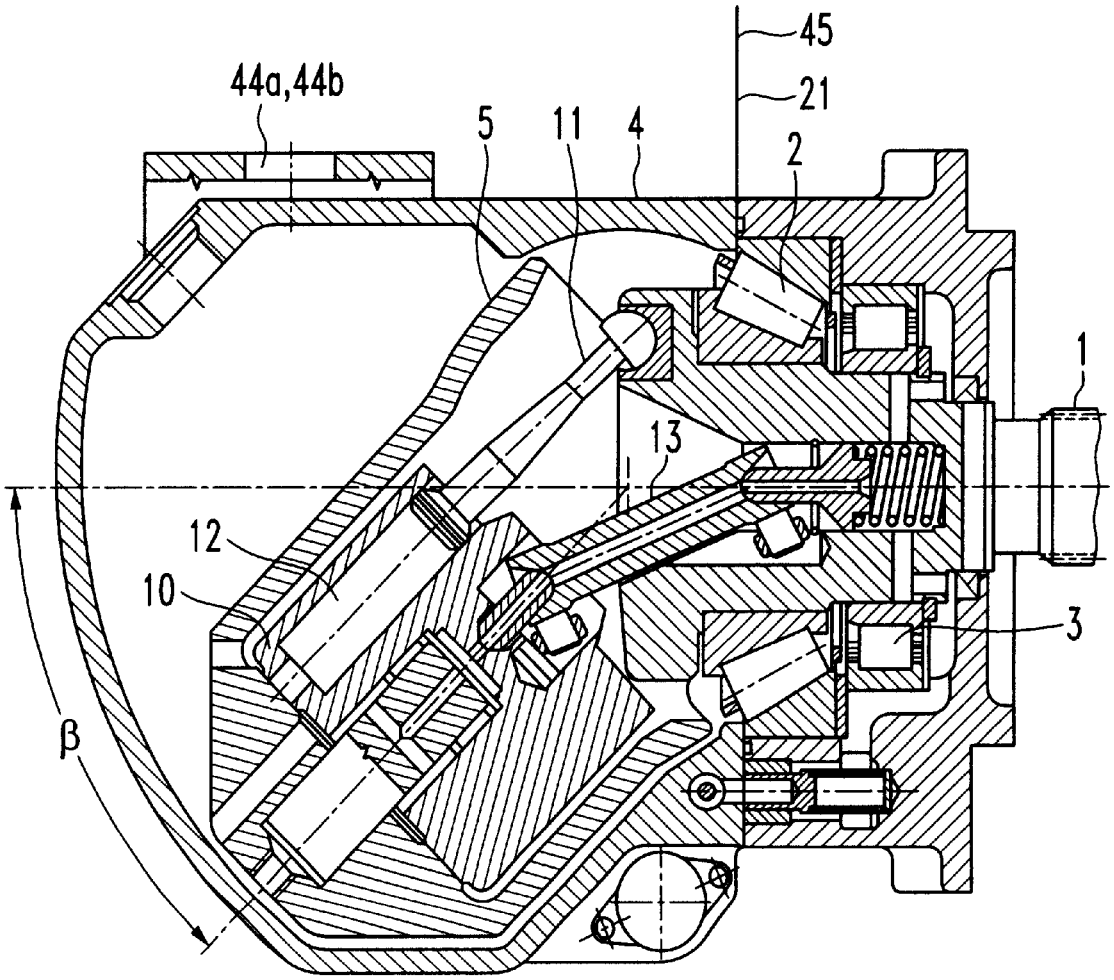
FIG. 2 shows a section along line A—A according to FIG. 1.

As can be seen from FIG. 2, which represents a section along line A—A according to FIG. 1, the output shaft 1 is mounted in the housing 4 by a first rolling-contact bearing 2 and a second rolling-contact bearing 3.

It can also be seen in this view that a working piston 11, which is connected to the output shaft 1, is mounted displaceably in a cylinder opening 12 of the cylinder block 10.

The pivoting body 5 is inclined by a pivoting angle 0 in 20 relation to the axis of the output shaft 1. In this illustration, this angle $\beta=45°$.

As can be seen in FIG. 1, the pivoting body 5 is subdivided into two symmetrical cylinder segments 51 and 52. These cylinder segments 51 and 52 form an imaginary cylindrical plane 53 which intersects the space in which the working pistons 11 and the cylinder block 10 are mounted.

It can be seen that non-stationary transfer channels 56*a* and 56*b* are arranged in the respective cylinder segments, the top ends of said transfer channels opening out into throughflow chambers 54*a*' and 54*b*'. These throughflow chambers 54*a*' and 54*b*' overlap with throughflow chambers 54*a* and 54*b* in the housing 4, which, in turn, are connected to stationary transfer channels 44*a* and 44*b*. The operating fluid is supplied via these channels 44*a* and 44*b*.

The plane of the hydrostatic slide mounting for the pivoting body 5, which coincides with the imaginary cylinder plane 53, is thus located in the region of said throughflow chambers 54*a*, 54*b*, 54*a*' and 54*b*'.

Figure 3:
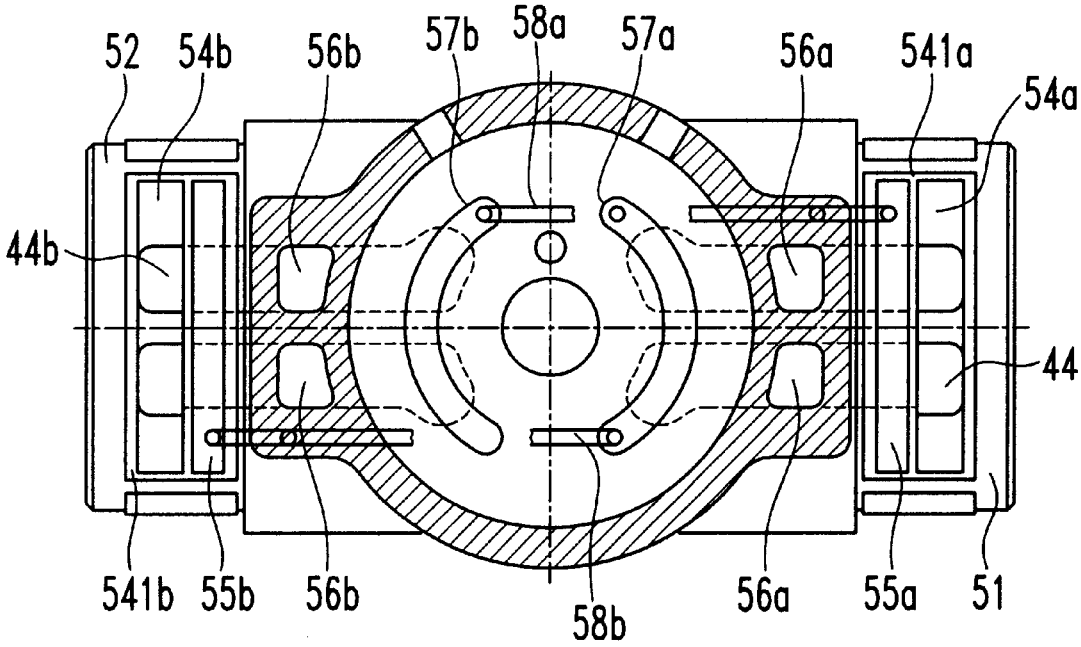
FIG. 3 shows a section along line B—B according to FIG. 1 of the pivoting body and of parts of the housing in the region of the mounting according to the invention.

FIG. 3 represents a sectional illustration along line B—B: according to FIG. 1, i.e. along the cylinder plane 53. In this view, it is possible to see the corresponding openings of the non-stationary transfer channels 56*a* and 56*b*, the openings of the stationary transfer channels 44*a* and 44*b* and the throughflow chambers 54*a* and 54*b*. These throughflow chambers 54*a* and 54*b* extend, transversely to the openings of the respective transfer channels, over more or less the entire length of the cylinder segments 51 and 52. In order to compensate as advantageously as possible for the forces acting on the pivoting body 5, the cylinder segments 51 and 52 are provided with corresponding compensation chambers 55*a* and 55*b*. The compensation chambers 55*a* and 55*b*, like the throughflow chambers 54*a* and 54*b*, are enclosed by corresponding sealing zones 541*a* and 541*b*. According to the invention, the compensation chamber 55*a* is connected to the circle-segment channel 57*b* via a connecting channel 58*a*, while the compensation chamber 55*b* is connected to the circle-segment channel 57*a* via a corresponding connecting channel 58*b*.

The pressure signal is then fed to said compensation chambers 55*a* and 55*b*, via the connecting channels 58*a* and 58*b*, from the non-stationary transfer channels 56*b* and 56*a* on the opposite side of the pivoting body 5.

Since the diameter of the cylinder segments 51 and 52 in the configuration according to the present invention is considerably smaller than the respective configurations from the prior art, the length of that stretch which each point of the imaginary cylindrical plane 53 has to cover during adjustment of the pivoting body 5 is also shorter.

It is thus always possible to provide a sufficient throughflow width for the throughflow chambers 54*a* and 54*b*. At the same time, it is possible to mount the pivoting body 5 in the stationary part of the housing 4 in the vicinity of the separating plane 45 of the housing 4. In this way, the vibrations of the housing which occur on account of the cyclic loading of the pivoting body 5, can be reduced to a considerable extent. As can be seen in FIG. 2, the end side 21 of the rolling-contact bearing 2 is thus located in the separating plane 45 of the housing 4.

Figure 4:
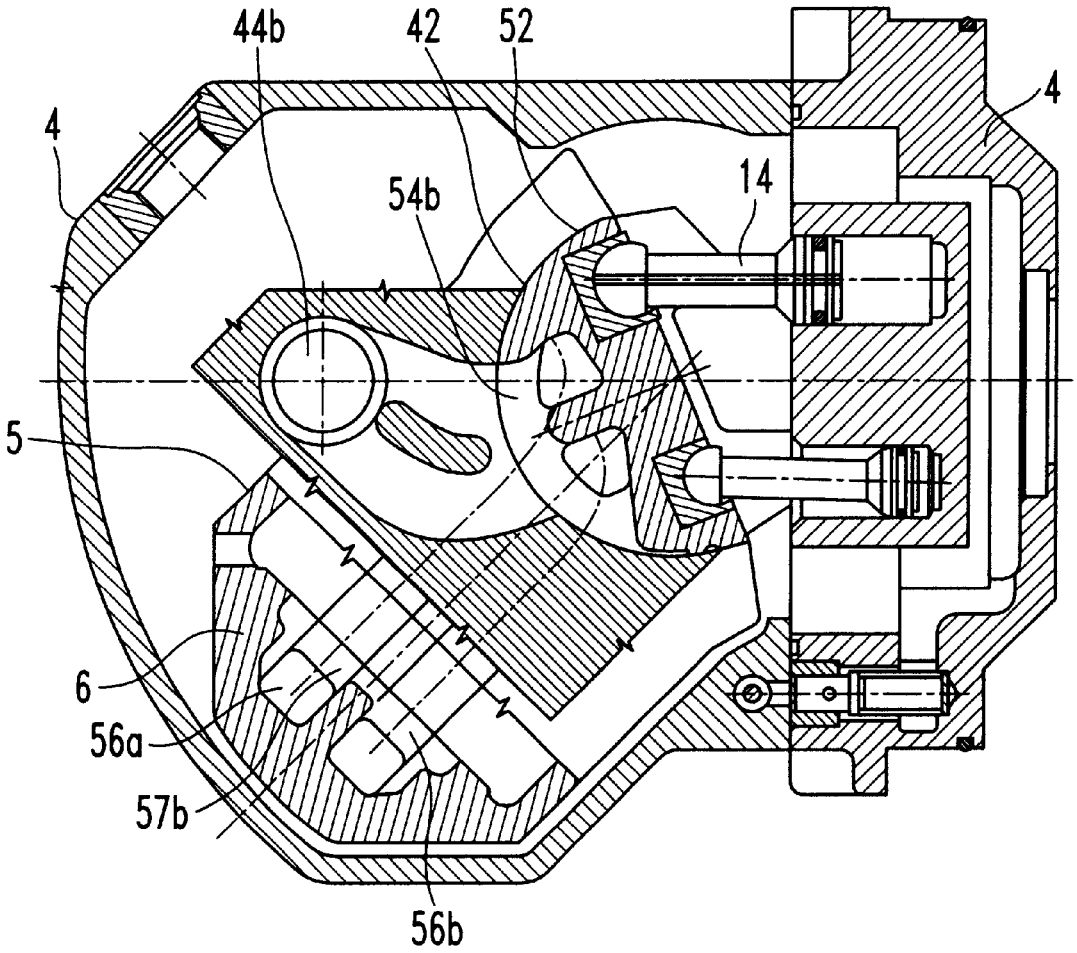
FIG. 4 shows a section along line C—C according to FIG. 1.

FIG. 4 shows a section along line C—C according to FIG. 1, i.e., a section through the left-hand cylinder segment 52 and the corresponding portion of the housing 4. The latter has the stationary transfer channel 44*b*, which then opens out into the throughflow chamber 54*b*. The cylinder segment 52 is mounted for hydrostatic sliding action in the hollow 42, while the opposite end is connected to the stationary part of the housing 4 by axially displaceable pins. The circle-segment channel 57*b* is arranged in the base 6 of the pivoting body 5. In the exemplary embodiment shown here, the non-stationary transfer channel 56*b*, which connects the segment channel 57*b* to the throughflow chamber 54*b*, is configured by two parallel channels.

The special configuration of the inclined-axis variable displacement unit can advantageously be used in particular in closed hydraulic circuits and with the geometrical stroke volume (conversion ratio) changing within wide limits, with a pivoting angle of up to $\beta=45°$. A further advantageous use is in pumps which do not require any movement reversal in the throughflow, as is the case, for example, in pumps for open hydraulic circuits.

It is clear that the inclined-axis variable displacement unit is distinguished by considerably reduced installation. dimensions both in the longitudinal direction of the output shaft and in the direction transverse thereto. As a result of the special design of the overlapping throughflow chambers, the throughflow cross sections between the non-stationary transfer channels within the pivoting body and the stationary transfer channels within the housing are always large enough, in the case of any pivoting angle of the pivoting body, in order to keep the reduction in the throughflow speed, and thus the energy losses during the power transfer, low. The special configuration according to the invention can realize the transfer of the quantity of operating fluid necessary for the power up to a maximum pivoting-angle value of 45°.

A further advantage of the invention is based on the fact that the corresponding dividing up of the pivoting body into two cylinder segments, and the positioning of the same, considerably reduces the transmission of vibrations from the pivoting body into the stationary part of the housing, which keeps the transmission of the structure-borne sound from the housing into the surroundings low, even in the case of a reduced housing weight.

The corresponding selection and positioning of the separating plane for a two-part configuration of the housing corresponding to the invention allows good access for the production tool used for producing the concave cylindrical hollows in the inner surface of the housing as well as effective axial positioning of the shaft relative to the housing.

It is therefore seen that this invention will accomplish at least all of its stated objectives.

List of designations

| | |
|---|---|
| 1 | Output shaft |
| 2 | First rolling-contact bearing |
| 3 | Second rolling-contact bearing |
| 4 | Housing of the unit |
| 5 | Pivoting body |
| 6 | Base of the pivoting body |
| 10 | Cylinder block |
| 11 | Working piston |
| 12 | Cylinder openings in the cylinder block |
| 13 | Synchronizing articulation |
| 14 | Pin |
| 21 | End side of the first rolling-contact bearing |
| 42 | Hollows |
| 44a, 44b | Stationary transfer channels |
| 45 | Separating plane of the housing |
| 51, 52 | Cylinder segments |
| 53 | Imaginary cylinder plane |
| 54a, 54b | Throughflow chambers in the housing |
| 54a', 54b' | Throughflow chambers in the pivoting body |
| 55a, 55b | Compensation chambers |
| 56a, 56b | Non-stationary transfer channels |
| 57a, 57b | Circle-segment channels |
| 58a, 58b | Connecting channels |
| 541a, 541b | Sealing zones |
| β | Pivoting angle |

We claim:

1. An inclined-axis variable displacement unit comprising an output shaft, mounted in a housing, and a-cylinder block, these being connected via a synchronizing articulation, and via working pistons which can be displaced axially in the cylinder block, the cylinder block being mounted axially in a pivoting body which can be pivoted in relation to the axis of the output shaft, characterized in that the pivoting body (5) has two symmetrical cylinder segments (51, 52) which are mounted for hydrostatic sliding action in mutually opposite concave cylindrical hollows (41, 42) in the inner surface of the housing (4).

2. An inclined-axis variable, displacement unit according to claim 1, characterized in that the hollows (41, 42) are arranged in the inner surface of the housing (4) such that a joint cylinder plane (53) defined by the cylinder surfaces of the opposite cylinder segments (51, 52) intersects the cylinder block (10) beneath the end side of the latter which is directed towards the output shaft (1), in the region of the mounting of the working pistons (11).

3. An inclined-axis variable displacement unit according to claim 1, characterized in that the hollows (41, 42) have throughflow chambers (54*a*, 54*b*) and sealing zones (541*a*, 541*b*).

4. An inclined-axis variable displacement unit according to claim 3, characterized in that the throughflow chambers (54*a*, 54*b*) are connected to stationary transfer channels (44*a*, 44*b*) arranged in the housing (4).

5. An inclined-axis variable displacement unit according to claim 3, characterized in that the cylinder segments (51, 52) each have throughflow chambers (54*a*', 54*b*') which overlap with the throughflow chambers (54*a*, 54*b*) in the hollows (41, 42).

6. An inclined-axis variable displacement unit according to claim 5, characterized in that the cylinder segments (51, 52) have compensation chambers (55*a*, 55*b*).

7. An inclined-axis variable displacement unit according to claim 6, characterized in that circle-segment channels (57*a*, 57*b*) are arranged in the base (6) of the pivoting body (5).

8. An inclined-axis variable displacement unit according to claim 7, characterized in that the throughflow chambers (54*a*', 54*b*') are connected, via non-stationary transfer channels (56*a*, 56*b*), to the corresponding segment channels (57*a*, 57*b*) located on the side associated with the latter.

9. An inclined-axis variable displacement unit according to claim 7, characterized in that the base (6) of the pivoting body (5) has a trapezoidal cross section in the plane formed by the axis of rotation of the cylinder block (10) and by the axis of an output shaft (1).

10. An inclined-axis variable displacement unit according to claim 6, characterized in that the compensation chambers (55*a*, 55*b*) are each connected, via a connecting channel (58*a*, 58*b*), to the non-stationary transfer channels (56*a*, 56*b*) or the circle-segment channels (57*a*, 57*b*) on the side located opposite the compensation chambers (55*a*, 55*b*).

11. An inclined-axis variable displacement unit according to claim 10, characterized in that the non-stationary transfer channels (56*a*, 56*b*) each comprise two essentially parallel channels.

* * * * *